United States Patent [19]

Berrio de la Fe

[11] 4,355,716

[45] Oct. 26, 1982

[54] CIGARETTE CASE

[76] Inventor: Alicia Berrio de la Fe, 63 Pi y Margall, Las Palmas de Gran Canaria, Spain

[21] Appl. No.: 217,456

[22] Filed: Dec. 17, 1980

[30] Foreign Application Priority Data

Dec. 17, 1979 [ES] Spain ..... 247.523

[51] Int. Cl.[3] ..... B65D 77/24; A24F 15/00; A24F 27/00

[52] U.S. Cl. ..... 206/90; 206/94

[58] Field of Search ..... 206/90, 93, 94, 92

[56] References Cited

U.S. PATENT DOCUMENTS

| | | | |
|---|---|---|---|
| 1,505,133 | 8/1924 | Derry | 206/91 |
| 1,927,200 | 9/1933 | Beebe | 206/94 |
| 1,943,052 | 1/1934 | Berry, Jr. | 206/94 |
| 2,076,137 | 4/1937 | Wilson | 206/94 |
| 2,273,611 | 2/1942 | Anderson et al. | 206/94 |
| 2,295,110 | 9/1942 | Harkleroad | 206/93 |
| 2,907,453 | 10/1959 | Weiss | 206/94 |
| 3,065,849 | 11/1962 | Rice et al. | 206/92 |
| 3,509,989 | 5/1970 | Woll | 206/94 |

FOREIGN PATENT DOCUMENTS

| | | |
|---|---|---|
| 250110 | 4/1926 | United Kingdom . |
| 286130 | 3/1928 | United Kingdom . |
| 290876 | 5/1928 | United Kingdom . |
| 342017 | 1/1931 | United Kingdom . |
| 360092 | 11/1931 | United Kingdom . |
| 387743 | 2/1933 | United Kingdom . |
| 408155 | 4/1934 | United Kingdom . |
| 412145 | 6/1934 | United Kingdom . |
| 586694 | 3/1947 | United Kingdom . |

*Primary Examiner*—William T. Dixson, Jr.
*Attorney, Agent, or Firm*—Wender, Murase & White

[57] ABSTRACT

An improved cigarette case including a plurality of matches disposed thereon so as to be immediately accessible for use, and a striking surface for lighting said matches.

1 Claim, 2 Drawing Figures

CIGARETTE CASE

The present invention refers to some important improvements introduced in the constitution of cigarette cases by means of which one provides them with a new element which makes them useful to perform an essential and complementary function of very practical use.

The improvements constituting the invention consist essentially in incorporating in the cigarette case, box or packing, as one should like to call it, a plurality of matches disposed in such a way as to be accessible and at hand in order to be used immediately to light a cigarette taken out of the packing. Means for igniting the matches are also included in the cigarette case.

The advantages achieved by the invention are quite obvious: first, they provide the smoker with great convenience by having at hand the matches without any need to look for them; second, there is assembled in one object the matches and cigarettes, thus occupying less space in the pocket or any other place where they may be carried; third, one has always available a lighting means, as very often one forgets that the matches were used up, or the gas or the flint of the lighter consumed; and fourth a reduction in costs is achieved, as one can do without the purchase of a match box.

Generally speaking, the invention consists in arranging at any of the surfaces of a cigarette case or packing a plurality of matches placed side by side and adhered to the case in such a way that they can easily be separated for use. Furthermore, some means to light the match is also included in the case, such as a scraper of sandpaper or similar material which can be situated on any of the surfaces of the case.

Further objects and advantages of the present invention will be apparent from the following description of the preferred embodiments when taken in conjunction with the accompanying drawings.

Figure 1:
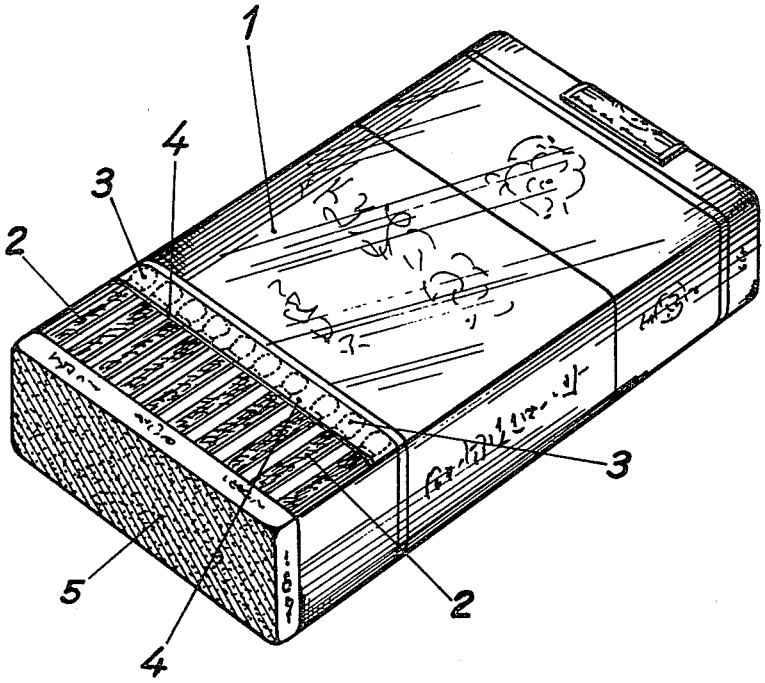
FIG. 1 is a perspective view of a preferred embodiment of a cigarette case according to the present invention in which the match heads are hidden inside the case.
Figure 2:
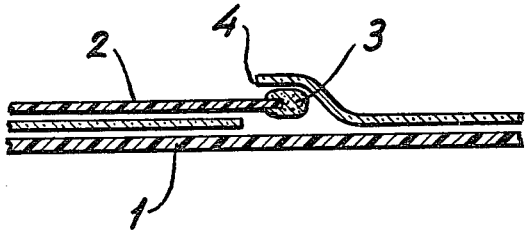
FIG. 2 is a partial cross-sectional view of the device of FIG. 1 showing details of the transverse slit and matches.

With reference to both FIGS. 1 and 2 the cigarette case or packing 1 may have the usual shape and capacity, or may be a special one, upon which a plurality of matches 2 are affixed. The matches are conveniently made of cardboard or bristol board and in form of bands with each match having a corresponding head 3, and all of them adhered one to another and, in the case of the examples illustrated in the drawings on the surface of the larger sides of the case or packing 1 at the under area near one of the smaller sides. These matches 2 may have the usual length, or be a bit shorter, as is the case of the example.

As shown in FIG. 1, the matches 2 are stuck on the surface of the cigarette packing or case 1 on at one of the larger sides and disposed parallel one to another and joined at one of the smaller sides. The matches 2 are adhered in such a way that they can be easily detached. The heads 3 of the matches are hidden and introduced in the packing or case 1 through a cut or opening 4, so that said heads 3 are not in direct contact with the cigarettes, but instead are placed between the outer covering and an interior lining of the case.

According to a second embodiment, the matches 2 are disposed in the same way as shown in FIG. 1, but their heads 3 look out of the cigarette packing or case, rather than being inserted into the opening.

Finally according to a third embodiment it is possible also to hide the heads 3 of the matches by means of a flap or edge from the covering of the packing or case, or stuck on it.

Each case 1 will be provided with a scraper or sandpaper 5 which is illustrated in FIGS. 1 and 2 as occupying the smaller inferior side of the case. Nevertheless this scraper can also be situated at another place and occupy only part of the surface of the side. Moreover the scraper or sandpaper 5 can be formed directly on the paper or cardboard of the cigarette case, or by means of an adhered sandpaper.

The improved cigarette case according to the invention can be manufactured in different shapes, sizes and materials, and can be provided with a variable number of matches which may be related to the quantity of cigarettes contained in the case or not. It is also possible to place the matches in a longitudinal direction on the case at one or both of the larger sides or even at the smaller sides, at one or both of them, as also the sandpaper or scraper and the matches can have different dimensions according to the different sizes of the case.

I claim:

1. A cigarette case, comprising:

a generally rectangular cigarette package having an inner lining and an outer wrapper;

a plurality of matches, each having an igniting head and a stem, said matches being arranged parallel each other and traversely spaced apart on a major side of said package;

said outer wrapper having a transverse slit, the heads of said matches being introduced into said slit and positioned between said wrapper and said lining, each of said matches being affixed directly to said package proximate the end of said stem opposite said igniting head, with a major portion of said stem being exposed on the exterior of said package; and an abrasive portion affixed to said package, whereby a selected one of said matches can be easily removed from said package and lighted on said abrasive portion.

* * * * *